US007022280B2

(12) United States Patent
Okawa

(10) Patent No.: US 7,022,280 B2
(45) Date of Patent: Apr. 4, 2006

(54) PROCESS OF MAKING A FLAT YARN FROM POLYOXYMETHYLENE FILM

(75) Inventor: Hidetoshi Okawa, Fuji (JP)

(73) Assignee: Polyplastics Co., Ltd., Tokyo (JP)

( * ) Notice: Subject to any disclaimer, the term of this patent is extended or adjusted under 35 U.S.C. 154(b) by 163 days.

(21) Appl. No.: 10/308,040

(22) Filed: Dec. 3, 2002

(65) Prior Publication Data

US 2003/0129391 A1 Jul. 10, 2003

(30) Foreign Application Priority Data

Dec. 14, 2001 (JP) ..... 2001-381517

(51) Int. Cl.
*D01D 5/42* (2006.01)
*D02G 3/02* (2006.01)
*D02J 1/22* (2006.01)

(52) U.S. Cl. ..... 264/564; 264/147; 264/210.5; 264/210.8; 264/235.6

(58) Field of Classification Search ..... 264/147, 264/210.5, 210.8, 235.6, 564

See application file for complete search history.

(56) References Cited

U.S. PATENT DOCUMENTS 3,616,002 A * 10/1971 Paquette et al. ..... 156/170
3,621,646 A 11/1971 Bobkowicz et al.

FOREIGN PATENT DOCUMENTS

| | | |
|---|---|---|
| EP | 04164932 | 10/1992 |
| EP | 05104619 | 4/1993 |
| GB | 748835 | 5/1956 |
| JP | 57-155473 | 9/1982 |
| JP | 58-46144 | 3/1983 |
| JP | 61-225309 | 10/1986 |
| JP | 1-229808 | 9/1989 |
| JP | 2094020 | 4/1990 |
| JP | 2000-256048 | 9/2000 |

* cited by examiner

*Primary Examiner*—Leo B. Tentoni
(74) *Attorney, Agent, or Firm*—Nixon & Vanderhye, PC

(57) ABSTRACT

A flat yarn of a high strength and a high modulus of elasticity, being excellent in solvent resistance, thermal stability and resistance to bending fatigue is provided. The flat yarn comprises polyoxymethylene copolymer containing 0.5 to 10 moles of specified oxyalkylene units per 100 moles of oxymethylene units in the polymer chain principally comprising repeating oxymethylene units and having a melt index at 190° C. with load of 2160 g of 0.3 to 20 g/10 min.

14 Claims, No Drawings

PROCESS OF MAKING A FLAT YARN FROM POLYOXYMETHYLENE FILM

FIELD OF THE INVENTION

The present invention relates to a flat yarn comprising a specified polyoxymethylene copolymer and having a high strength and a high modulus of elasticity and a production process thereof. Also, it relates to processed products using the flat yarn.

RELATED ARTS

Almost all conventional flat yarns comprise a polyolefin resin such as polypropylene, polyethylene or the like. These are inexpensive and are used for various purposes as a packing string or further as a multipurpose sheet obtained by processing the flat yarn to a woven fabric. However, the polyolefin resin has low crystallinity and therefore, the flat yarn comprising the polyolefin resin is limited on strength after stretching, and the strength may be insufficient depending on a use. Also, the polyolefin resin cannot sufficiently meet recent requirements for a flat yarn with higher strength or secondary processed goods such as a woven fabric comprising the flat yarn.

On the other hand, a polyoxymethylene resin is a polymer having a polymer skeleton mainly comprising repeating oxymethylene units, has high degree of crystallinity and is known to be excellent in rigidity, strength, chemical resistance, solvent resistance and the like. Furthermore, since a rate of crystallinity is fast and a molding cycle is rapid, the polyoxymethylene resin is widely used predominantly in a field of mechanism elements of a car and an electrical machinery and apparatus, as injection molding materials. It is also known that the polyoxymethylene resin has high crystallinity and therefore, can produce a product having high strength and high elasticity owing to oriented crystallinity by stretching.

As such, the polyoxymethylene resin is a resin having various excellent properties, however, is fast in the rate of crystallinity and therefore has some kinds of limitation in a forming process thereof. As a result, there arises a problem, for example, in a stretching step of films, fabrics or the like, a void within fibrils readily occurs and the films, the fabrics or the like are readily cut off, therefore, productivity cannot be improved and a stretched product having high strength is hardly obtained. Similarly, it is considered that the polyoxymethylene resin is not applicable to production of flat yarns in view of the high degree of crystallinity or the fast rate of crystallinity, and it is not being subjected to an object of studies. As conventional techniques with respect to the flat yarns, many publications are present, for example, JP-A 57-155473, JP-A 58-46144, JP-A 61-225309, JP-A 1-229808 and JP-A 2000-256048. However, these are applications with respect to the flat yarn comprising a polyolefin resin or a polyester resin and various uses using the flat yarn. The flat yarn comprising the polyoxymethylene resin or an application thereof is not absolutely disclosed.

DISCLOSURE OF THE INVENTION

The object of the present invention is to solve the above-described problem and to provide a flat yarn comprising a polyoxymethylene resin with high strength and high modulus of elasticity and a production process thereof having good production efficiency.

As a result of extensive investigations to attain the above-described objects, the present inventor has found that by using a polymer of the polyoxymethylene resin where the rate of crystallinity is controlled, a stable film formation and film stretch can be achieved, and a flat yarn of high strength and high modulus of elasticity and excellent in solvent resistance, thermal resistance and resistance to bending fatigue can be obtained. The present invention has been accomplished based on this finding.

More specifically, the present invention is a flat yarn comprising a polyoxymethylene copolymer containing 0.5 to 10 moles of oxyalkylene units represented by the following formula (1) per 100 moles of oxymethylene units in the polymer chain principally comprising repeating oxymethylene units and having a melt index at 190° C. with load of 2160 g of 0.3 to 20 g/10 min:

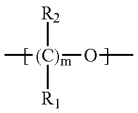

(1)

in which $R_1$ and $R_2$ represent hydrogen atom, an alkyl group of 1 to 8 carbon atoms, an organic group having an alkyl group of 1 to 8 carbon atoms, a phenyl group or an organic group having a phenyl group, $R_1$ and $R_2$ may be identical to or different from each other and m represents an integer of 2 to 6.

The invention is also a process for producing a flat yarn, which comprises the steps of forming film from a polyoxymethylene copolymer containing 0.5 to 10 moles of oxyalkylene units represented by the following formula (1) per 100 moles of oxymethylene units and having a melt index at 190° C. with load of 2160 g of 0.3 to 20 g/10 min. in the polymer chain principally comprising repeating oxymethylene units and then slitting the film into a strip by passing it through a slitter:

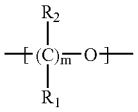

(1)

in which $R_1$ and $R_2$ represent hydrogen atom, an alkyl group of 1 to 8 carbon atoms, an organic group having an alkyl group of 1 to 8 carbon atoms, a phenyl group or an organic group having a phenyl group, $R_1$ and $R_2$ may be identical to or different from each other and m represents an integer of 2 to 6.

The invention further provides a woven fabric of the flat yarn, a sheet coated by melt-coating a thermoplastic resin on the woven fabric, a concrete curing sheet comprising the woven fabric, a soil-reinforcing sheet product comprising the woven fabric, a cereal grain bag comprising the woven fabric, a soil bag comprising the woven fabric, a non-woven fabric comprising the flat yarn, a net-like product comprising the flat yarn, a carpet substrate cloth comprising the flat yarn, a concrete reinforcing fiber formed by cutting the flat yard of a length of 5 to 100 mm and a plastic string comprising the flat yarn.

DETAILED DESCRIPTION OF THE INVENTION

The present invention is described in detail below. At first, the flat yarn of the present invention and the polyoxymethylene copolymer for use in the production process of the flat yarn are described.

In the flat yarn of the present invention and the production process thereof, a polyoxymethylene copolymer containing 0.5 to 10 mol of oxyalkylene units represented by the formula (1) per 100 mol of oxymethylene units in the polymer chain mainly comprising repeating oxymethylene units is used.

In the polyoxymethylene copolymer for use in the present invention, the oxyalkylene units represented by the formula (1) is indispensably contained in a ratio of from 0.5 to 10 mol per 100 mol of the oxymethylene units, preferably from 1.2 to 8 mol, more preferably from 2 to 6 mol per 100 mol of the oxymethylene units. When the ratio of the oxyalkylene units represented by the formula (1) is excessively reduced, the rate of crystallinity of the polyoxymethylene copolymer is increased, as a result, a uniform film is hardly produced in a film production as a flat yarn pre-step, or cutoff readily occurs due to generation of a void within fibrils in the case of slitting a film by passing through a slitter and further stretching the slitted film to obtain the flat yarn. When the ratio of the oxyalkylene units presented by the formula (1) is excessively increased, ultimate crystallinity is lowered, and the flat yarn having high strength cannot be obtained.

In the polyoxymethylene copolymer for use in the present invention, a melt index (MI) measured at 190° C. under a load of 2160 g according to ASTM D-1238 is inevitably from 0.3 to 20 g/10 min, preferably 0.5 to 10 g/10 min, more preferably 0.5 to 5 g/10 min. If the melt index (MI) is too small, the load in the film production as the flat yarn pre-step is increased and extrusion is hardly performed, whereas if the melt index (MI) is excessively large, the production of the film becomes unstable due to draw down of a resin.

A production process of the above-described polyoxymethylene copolymer for use in the present invention is not particularly limited. The polyoxymethylene copolymer can be generally obtained by a method where trioxane, and a cyclic ether compound or a cyclic formal compound as a comonomer are subjected to block polymerization predominantly using a cationic polymerization catalyst. For a polymerizer, all of commonly known apparatuses such as batch type, continuous type or the like can be used. Herein, the introduction ratio of the oxyalkylene units represented by the formula (1) described above can be adjusted based on the amount of the comonomer copolymerized. Also, the melt index (MI) described above can be adjusted based on the added amount of a chain transfer agent used at the polymerization, such as methylal or the like.

Examples of the cyclic ether compound or the cyclic formal compound used as the comonomer include ethylene oxide, propylene oxide, butylene oxide, epichlorohydrin, epibromohydrin, styrene oxide, oxetane, 3,3-bis(chloromethyl)oxetane, tetrahydrofuran, trioxepane, 1,3-dioxolan, propylene glycol formal, diethylene glycol formal, triethylene glycol formal, 1,4-butanediol formal, 1,5-pentanediol formal and 1,6-hexanediol formal. Among these, preferred are ethylene oxide, 1,3-dioxolan, diethylene glycol formal and 1,4-butanediol formal.

The polyoxymethylene copolymer may have a branched or crosslinked structure.

The polyoxymethylene copolymer obtained by the polymerization is put into practical use by performing the deactivation treatment of a catalyst, the removal of an unreacted monomer, the washing and drying of the polymer, the stabilization treatment of an unstable terminal part and thereafter further performing the stabilization treatment by blending various stabilizers. Representative examples of the stabilizer include hindered phenolic compound, nitrogen-containing compound, hydroxide, inorganic salt, carboxylate of alkali or alkaline earth metal.

In the thus-obtained polyoxymethylene copolymer for use in the present invention, the amount of hemi-formal terminal groups detected by $^{1}$H-NMR is preferably from 0 to 4 mmol/kg, more preferably from 0 to 2 mmol/kg. In the case where the amount of the hemi-formal terminal groups exceeds 4 mmol/kg, there arises a problem such as foaming accompanying decomposition of the polymer at melt-processing, as a result, a break of films disadvantageously occurs. In order to control the amount of the hemi-formal terminal groups within the above-described range, the amount of impurities, particularly, water content in the total amount of the monomer or comonomer subjected to the polymerization is preferably adjusted to 20 ppm or less, more preferably 10 ppm or less.

The polyoxymethylene copolymer for use in the present invention may also contain, if desired, one or more of additives commonly used for a thermoplastic resin, such as coloring agent (dye or pigment), lubricant, nuclear agent, mold-releasing agent, antistatic agent, surfactant or organic polymer material and inorganic or organic filler in a form of fiber, plate or powder particle, within the range of not impairing the object of the present invention.

Next, a production process for a flat yarn by using the polyoxymethylene copolymer as described above will be described. The flat yarn of the present invention can be obtained by once forming a film from the polyoxymethylene copolymer as described above and slitting the film into a strip-form by passing through a slitter. A process of stretching under heat the strip slitted by passing through the slitter is also preferable because a flat yarn having higher strength and higher modulus of elasticity can be obtained.

Herein, a forming method of films is not limited and a method such as an inflation method or a T die method is used. The inflation method is a method where a resin is heat-melted within an extruder and then, a melted resin obtained is extruded into a tube form from a cyclic extrusion forming mouthpiece and inflated by blowing a fluid such as air within the tube to form into a tube-like film. The T die method is a method where a resin is heat-melted within an extruder and then, a melted resin obtained is extruded from a linear slit extrusion molding mouthpiece to form into a film.

The flat yarn of the present invention can be obtained by that the thus-obtained film is cut into a tape-form with a length of about tens of mm or less by passing through a slitter or the strip slitted is further stretched while heating and the resulting molecular state is heat set under heat. The heating method at the stretching is not particularly limited and various methods may be used, such as a method of bringing the strip into contact with the surface of a hot plate or a method of allowing the strip to pass through a heated gas or a heated liquid. Herein, the stretch and heat set conditions of the strip are preferably such that the strip is monoaxially stretched by 2 to 15 times at a temperature higher than the glass transition point and lower than the melting point of the polyoxymethylene copolymer and then heat set at a temperature of 120° C. or higher and lower than the melting point, more preferably such that the strip is monoaxially stretched by 2 to 15 times at a temperature of 80° C. or higher and 170° C. or lower and then heat set at a temperature of 120° C. or higher and 180° C. or lower.

The flat yarn made of polyoxymethylene resin of the present invention has various uses, utilizing the excellent properties such as high strength, high modulus of elasticity, excellent solvent resistance, superior thermal resistance and high resistance to bending fatigue. The flat yarn, having a yarn-like form, is processed into a form of woven fabric, non-woven fabric, net or the like depending on the use end, whereby the flat yarn may be applied to carpet substrate cloth, concrete curing sheet and soil-reinforcing sheet product, and may also be applied to cereal grain bag, soil bag and plastic string each comprising a flat yarn woven fabric. The woven fabric may be formed into a sheet usable for civil engineering, architecture, leisure or the like as a waterproof sheet coated by melt-coating a thermoplastic resin on the woven fabric. Further, the flat yarn is appropriately cut to obtain a product (a product obtained by cutting the yarn to from 5 to 100 mm in length is preferable) and the product can be used as a concrete-reinforcing fabric. By virtue of properties of the polyoxymethylene resin, these various products exhibit excellent properties in strength, rigidity and durability.

EXAMPLES

The present invention is described in more detail below by referring to the Examples. However, the present invention is not limited to them.

Examples 1 to 11

Using a continuous mixing reactor constructed by a barrel which has a jacket passing through a heat medium (or a coolant) on the outside and which comprises a cross section having a shape where two circles are partially overlapped, and a rotation axis with a paddle, a block polymerization was performed, where a liquid trioxane and 1,3-dioxolan (comonomer) were added to the polymerizer and then thereto, methylal as a molecular weight modifier and 50 ppm (based on the whole monomer) of boron trifluoride as a catalyst were further continuously fed at the same time, while rotating each of two rotation axes with paddles at 150 rpm, whereby a polymer having the comonomer amount shown in Table 1 was prepared. The reaction product exhausted from the polymerizer was added to an aqueous solution at 60° C. containing 0.05% by weight of triethylamine while swiftly passing through a crusher, whereby the catalyst was deactivated. Further, separation, washing and drying was performed and then, a coarse polyoxymethylene copolymer was obtained.

Subsequently, to 100 parts by weight of this coarse polyoxymethylene copolymer, 4 parts by weight of an aqueous 5% by weight triethylamine solution and 0.3 part by weight of pentaerythritol-tetrakis[3-(3,5-di-tert-butyl-4-hydroxyphenyl)propionate were added and melt-kneaded at 210° C. by a twin extruder, whereby an unstable part was removed.

To 100 parts by weight of the polyoxymethylene resin obtained by the above-described method, 0.03 part by weight of pentaerythritol-tetrakis[3-(3,5-di-tert-butyl-4-hydroxyphenyl)propionate as a stabilizer and 0.15 part by weight of melamine were added and melt-kneaded at 210° C. by the twin extruder, whereby a pellet-form polyoxymethylene resin was obtained.

Using a polymer obtained and an extrusion forming machine where a cylinder set temperature was 200° C., a tube-like film was extruded at die lip intervals of 1 mm and at a resin temperature of 200 to 220° C. by the inflation method, whereby a film with a thickness of 30 μm was obtained and slitted to 1 cm in width. The strip slitted was stretched to the longitudinal direction at a magnification shown in Table 1 and subjected to the heat set treatment at 160° C. for 2 seconds to obtain a flat yarn. The obtained flat yarn was evaluated. The results thereof are shown in Table 1.

Comparative Examples 1 to 5

In the same manner as in Examples, a polyoxymethylene resin other than the resin specified by the present invention as shown in Table 1 was prepared to obtain a flat yarn and the obtained flat yarn was similarly evaluated. The results thereof are shown in Table 1.

The evaluation criteria and the like in Examples and Comparative Examples are shown below.

[Melt Index (MI) Measurement]

The melt index was measured at 190° C. under a load of 2160 g in accordance with ASTM D-1238.

[Polymer Composition Analysis]

The polymer used for the evaluation of physical properties was dissolved in hexafluoroisopropanol $d_2$, and the resulting polymer was subjected to the measurement of $^1$H-NMR. The polymer composition was quantitated by a peak area corresponding to each unit.

[Terminal Group Analysis]

The polymer used for the evaluation of physical properties was dissolved in hexafluoroisopropanol $d_2$, and the resulting polymer was subjected to the measurement of $^1$H-NMR. The amount of terminal groups was quantitated by a peak area corresponding to each terminal group.

[Strength]

The strength was measured using a tensile tester.

TABLE 1

| | Polymer Composition | | | Amount of Hemi-Formal Terminal | | |
|---|---|---|---|---|---|---|
| | Copolymerization Unit | Mol % | MI (g/10 min) | Groups (mml/kg) | Stretching Magnification | Strength (g/d) |
| Ex. | | | | | | |
| 1 | $(CH_2CH_2O)$ | 1.3 | 2 | 0.2 | 5.2 | 6.8 |
| 2 | $(CH_2CH_2O)$ | 2.2 | 2 | 0.2 | 5.8 | 7.54 |
| 3 | $(CH_2CH_2O)$ | 4.0 | 2 | 0.2 | 7.8 | 10.1 |

TABLE 1-continued

| | Polymer Composition | | | Amount of Hemi-Formal Terminal | | |
|---|---|---|---|---|---|---|
| | Copolymerization Unit | Mol % | MI (g/10 min) | Groups (mml/kg) | Stretching Magnification | Strength (g/d) |
| 4 | $(CH_2CH_2O)$ | 2.2 | 2 | 5 | 5.7*1 | 7.4*1 |
| 5 | $(CH_2CH_2O)$ | 2.2 | 2 | 0.2 | 6.8 | 8.8 |
| 6 | $(CH_2CH_2O)$ | 0.7 | 2 | 0.2 | 4.1 | 5.3 |
| 7 | $(CH_2CH_2O)$ | 9.8 | 2 | 0.2 | 6.8 | 6.2 |
| 8 | $(CH_2CH_2O)$ | 9.8 | 14 | 0.2 | 5.8 | 5.8 |
| 9 | $(CH_2CH_2O)$ | 2.2 | 14 | 0.2 | 6.6 | 6.1 |
| 10 | $(CH_2CH_2CH_2CH_2O)$ | 2.2 | 2 | 0.2 | 6.0 | 7.8 |
| 11 | $(CH_2CHO_2CH_2CH_2O)$ | 2.2 | 2 | 0.2 | 6.3 | 8.2 |
| Com. Ex. | | | | | | |
| 1 | $(CH_2CH_2O)$ | 0.48 | 2 | 0.2 | 3.4 | 4.1 |
| 2 | — | — | 2 | 0.2 | 2.8 | 3.6 |
| 3 | $(CH_2CH_2O)$ | 2.2 | 27 | 0.2 | —*2 | —*2 |
| 4 | $(CH_2CH_2O)$ | 2.2 | 0.2 | 0.2 | —*3 | —*3 |
| 5 | $(CH_2CH_2O)$ | 4.0 | 45 | 0.2 | —*2 | —*2 |

*1In the film formation step, a foaming was observed and a film break readily occurred.
*2The melting viscosity was low, as a result, a film was not fabricated and a yarn was not obtained.
*3The melting viscosity was high and a film extrusion load was excessively increased, as a result, a film was not stably fabricated and a yarn was not obtained.

The invention claimed is:

1. A process for producing a flat yarn, which comprises the steps of:

(a) providing a polyoxymethylene copolymer having a melt index at 190° C. with a load of 2160 g of 0.3 to 20 g/10 min., the polyoxymethylene copolymer being comprised mainly of repeating oxymethylene units and containing 0.5 to 10 moles of oxyalkylene units represented by the following formula (1) per 100 moles of the oxymethylene units in the polymer chain:

(1)

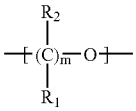

in which $R_1$ and $R_2$ represent hydrogen atom, an alkyl group of 1 to 8 carbon atoms, an organic group having an alkyl group of 1 to 8 carbon atoms, a phenyl group or an organic group having a phenyl group, $R_1$ and $R_2$ may be identical to or different from each other and m represents an integer of 2 to 6;

(b) melting the polyoxymethylene copolymer provided according to step (a) and forming a film therefrom by inflation extrusion or T-die extrusion;

(c) slitting the film obtained according to step (b) into a plurality of strips by passing the film through a slitter;

(d) monoaxially stretching the strips obtained in step (c) 2 to 15 times at a temperature of between 80° C. and 170° C.; and then (e) heat-setting the monoaxially stretched strips at a temperature between 120° C. and 180° C. to obtain a flat yarn thereof.

2. The process as defined in claim 1, wherein the polyoxymethylene copolymer contains 1.2 to 8 mol of the oxyalkylene units per 100 mol of the oxymethylene units.

3. The process as defined in claim 1, wherein the polyoxymethylene copolymer contains 2 to 6 moles of the oxyalkylene units per 100 mol of the oxymethylene units.

4. The process as defined in claim 1, wherein the polyoxymethylene copolymer has a melt index of 0.5 to 10 g/10 min.

5. The process as defined in claim 1, wherein the polyoxymethylene copolymer has a melt index of 0.5 to 5 g/10 min.

6. The process as defined in claim 1, wherein the polyoxymethylene copolymer as a branched or crosslinked structure.

7. The process as defined in claim 1, wherein the polyoxymethylene copolymer has 0 to 4 mmoles/kg of hemi-formal terminal groups.

8. A process for producing a flat yarn, which comprises the steps of:

(a) providing a polyoxymethylene copolymer having a melt index at 190° C. with a load of 2160 g of 0.3 to 20 g/10 min., the polyoxymethylene copolymer being comprised mainly of repeating oxymethylene units and containing 0.5 to 10 moles of oxyalkylene units represented by the following formula (1) per 100 moles of the oxymethylene units in the polymer chain:

(1)

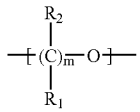

in which $R_1$ and $R_2$ represent hydrogen atom, an alkyl group of 1 to 8 carbon atoms, an organic group having an alkyl group of 1 to 8 carbon atoms, a phenyl group or an organic group having a phenyl group, $R_1$ and $R_2$ may be identical to or different from each other and m represents an integer of 2 to 6;

(b) melting the polyoxymethylene copolymer provided according to step (a) and forming a film therefrom by inflation extrusion or T-die extrusion;

(c) slitting the film obtained according to step (b) into a plurality of strips by passing the film through a slitter;

(d) monoaxially stretching the strips obtained in step (c) 2 to 15 times at a temperature which is between the glass transition point and the melting point of the polyoxymethylene copolymer; and then (e) heat-setting the monoaxially stretched strips at a temperature between 120° C. and the melting point of the polyoxymethylene copolymer to obtain a flat yarn thereof.

9. The process as defined in claim 8, wherein the polyoxymethylene copolymer contains 1.2 to 8 mol of the oxyalkylene units per 100 mol of the oxymethylene units.

10. The process as defined in claim 8, wherein the polyoxymethylene copolymer contains 2 to 6 moles of the oxyalkylene units per 100 mol of the oxymethylene units.

11. The process as defined in claim 8, wherein the polyoxymethylene copolymer has a melt index of 0.5 to 10 g/10 min.

12. The process as defined in claim 8, wherein the polyoxymethylene copolymer has a melt index of 0.5 to 5 g/10 min.

13. The process as defined in claim 8, wherein the polyoxymethylene copolymer as a branched or crosslinked structure.

14. The process as defined in claim 8, wherein the polyoxymethylene copolymer has 0 to 4 mmoles/kg of hemi-formal terminal groups.

* * * * *